United States Patent [19]

Schmidt et al.

[11] 4,392,412

[45] Jul. 12, 1983

[54] GASEOUS BLAST REDUCER

[75] Inventors: Edward M. Schmidt, Forest Hill; George D. Kahl, Aberdeen, both of Md.

[73] Assignee: The United States of America as represented by the Secretary of the Army, Washington, D.C.

[21] Appl. No.: 202,220

[22] Filed: Oct. 30, 1980

[51] Int. Cl.[3] ..... F41F 17/12

[52] U.S. Cl. ..... 89/14 D; 86/1 B; 169/49

[58] Field of Search ..... 42/1 N; 86/1 B; 89/14 A, 14 B, 14 D; 102/303, 316, 323, 324; 169/45, 48, 49; 181/115, 223

[56] References Cited

U.S. PATENT DOCUMENTS 2,586,706 2/1952 Parr ..... 181/115
2,935,912 5/1960 Hartley ..... 89/14 A

FOREIGN PATENT DOCUMENTS 520969 5/1940 United Kingdom ..... 169/49

*Primary Examiner*—Stephen C. Bentley
*Attorney, Agent, or Firm*—Robert P. Gibson; Anthony T. Lane; Max Yarmovsky

[57] ABSTRACT

A gaseous blast reducer employs a membrane which is effective to contain a mass of gas having properties different from air, in the vicinity of the source of the blast. The blast is forced to propagate through the mass of gas before propagating in the air. An acoustic mismatch caused by the difference in properties between the gas and air reduces or attenuates the blast.

5 Claims, 12 Drawing Figures

FIG. 1
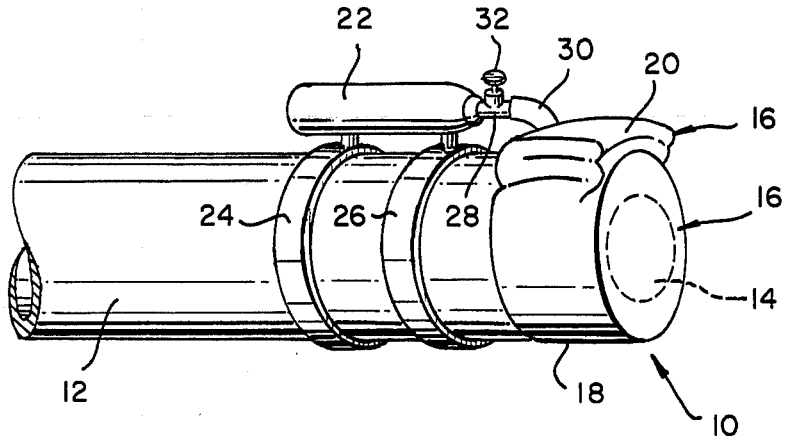
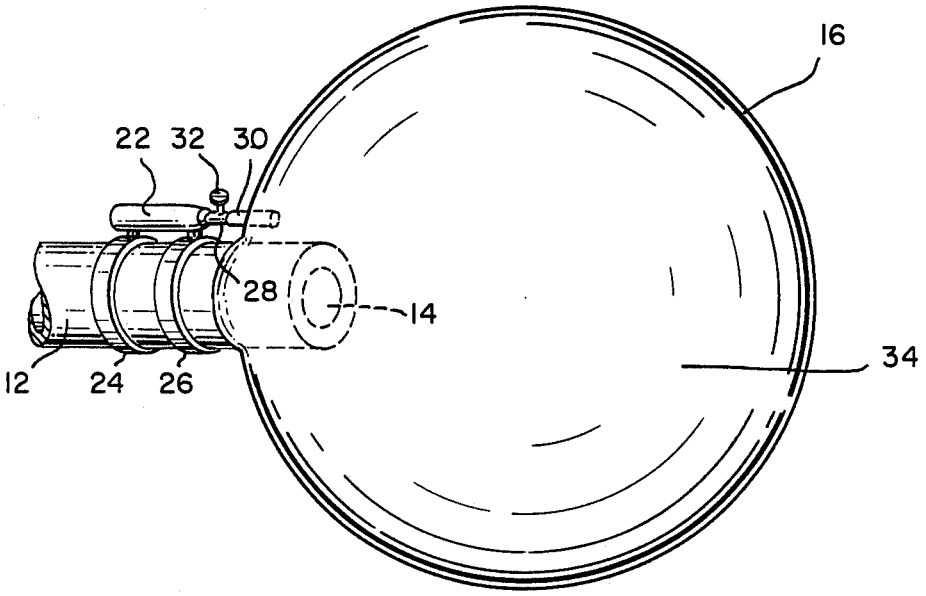
FIG. 2

FIG. 3
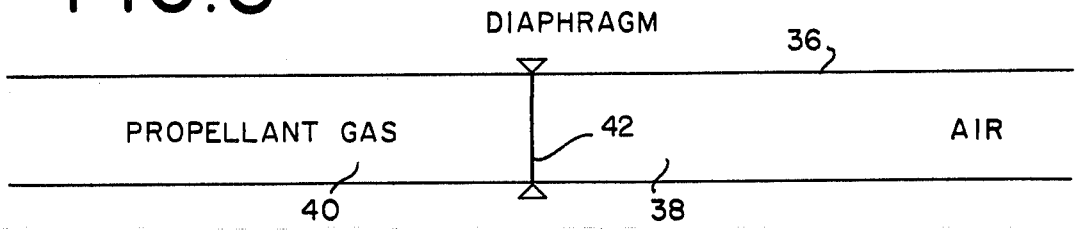
$p_4 = 270\ p_1$ $p_1$ = ATMOSPHERIC PRESSURE $p$ = PRESSURE
$u_4 = 0$ $u_1 = 0$ $u$ = VELOCITY
$\gamma_4 = 1.25$ $\gamma_1 = 1.4$ $\gamma = \frac{C_p}{C_v}$
$C_p$ = Constant pressure specific heat.
$C_v$ = Constant volume specific heat.
FIG. 4
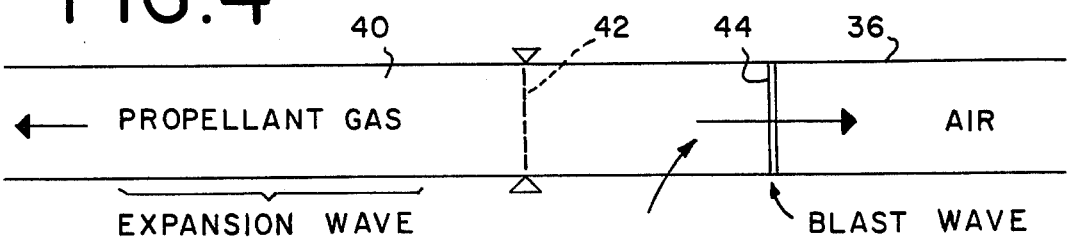
$p_2 = 25.7\ p_1$ $u_2 = 1349$ m/s
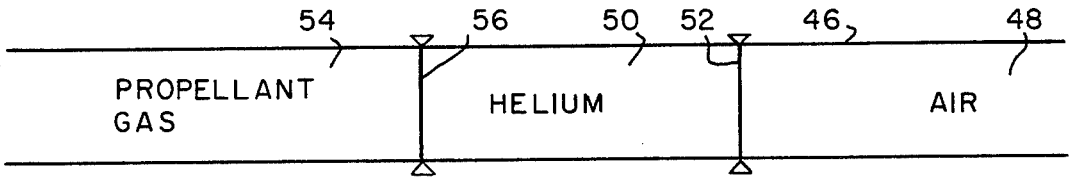
$p_4 = 270\ p_1$ $p_1' = p_1$ $p_1$ = ATMOSPHERIC PRESSURE
$\gamma_4 = 1.25$ $\gamma_1' = 1.67$ $\gamma_1 = 1.4$
FIG. 5

FIG. 10
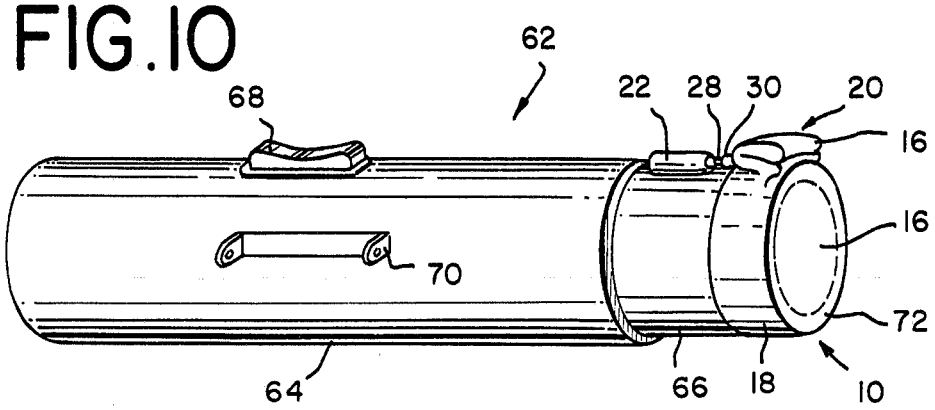
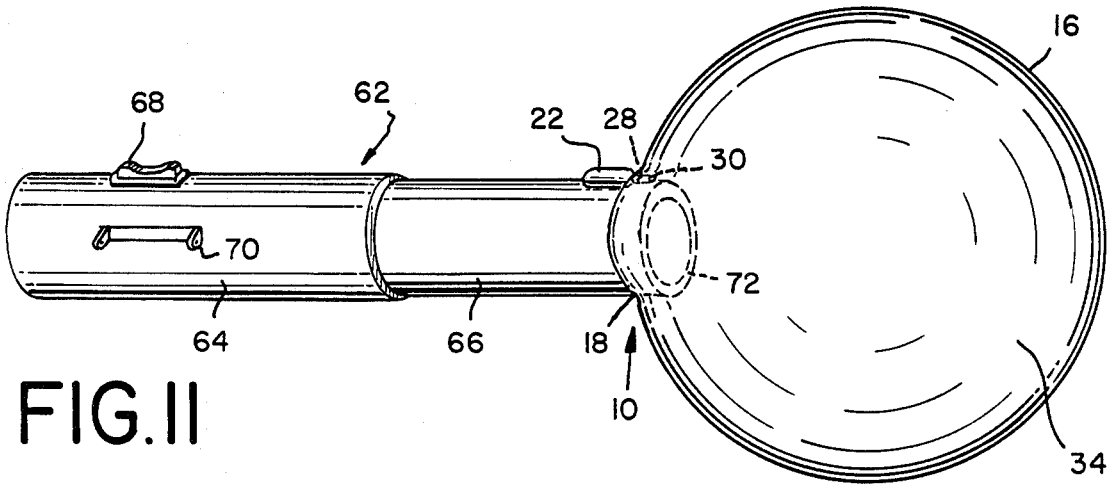
FIG. 11
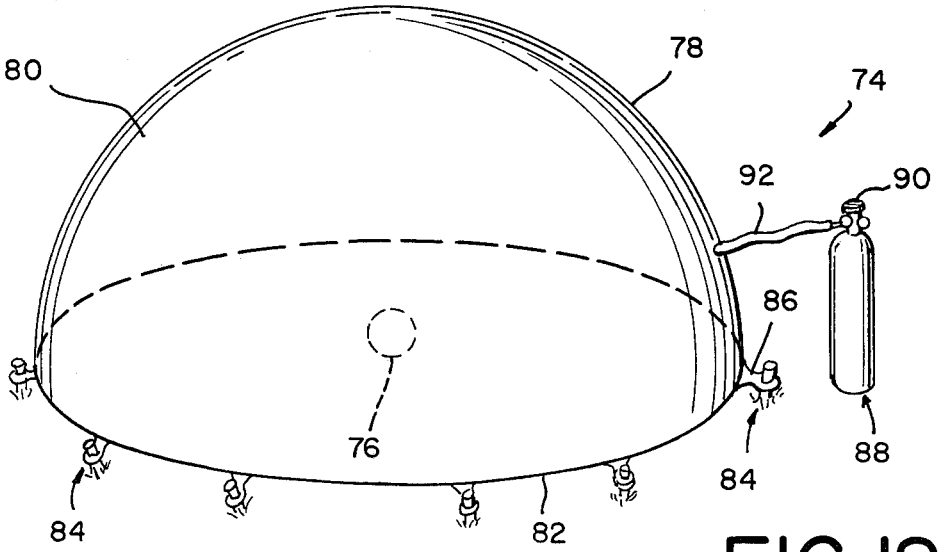
FIG. 12

GASEOUS BLAST REDUCER

GOVERNMENT INTEREST

The invention described herein may be manufactured, used and licensed by or for the Government for governmental purposes without the payment to me of any royalties thereon.

BACKGROUND OF THE INVENTION

Muzzle blast from guns and rockets as well as blast from detonation of bare charges represent substantial noise pollution sources. This problem is especially severe in military installations where residential encroachment places neighbors relatively close to sites where test firing is necessary. Furthermore, high blast and noise levels may pose physiological and/or psychological problems for the firing crew in field use.

In the past, mechanical devices such as silencers have been used to reduce the muzzle blast from guns. Such silencers are designed to slowly release the pressure of the propellent gases after the propellent gases have completed their task of accelerating the projectile. Silencers unfortunately weigh a significant fraction of the overall gun weight and have physical dimensions which may, in fact, exceed the physical dimensions of the gun barrel. In small caliber applications, the weight, although providing inconvenience, may be tolerable.

Although they may be acceptable in proving ground applications where large blast suppressors may be permanently mounted, the size and weight penalty of mechanical silencers are not acceptable for field use with large caliber weapons in a modern highly mobile military environment where survivability requires rapid movement from firing position to firing position.

An alternative to mechanical silencers for blast reduction includes placing a mass of aqueous foam surrounding, and forward of, the muzzle of the weapon. This technique requires a confinement device of some sort which may be filled with the aqueous foam from a foam generator prior to weapon firing. The foam acts to quench the strength of the blast through mechanisms which are not definitely established. The requirement for a foam generation system and a mechanical confinement apparatus reduces the attractiveness of such a technique. No foam system of blast suppressions are currently known to have been developed to a practical condition.

Rocket devices also have blast and noise over-pressure problems particularly in the case of shoulder-fired rockets. The blast and noise over-pressure levels may reach limits which produce psychological or physiological harm to the firing crew. Of the methods previously employed to reduce the blast and noise over-pressure reaching the firing crew, virtually all involve addition of material to the weapon system. If a weapon which is nominally man portable increases in weight significantly, it loses its field utility since it no longer can be carried and served.

Blast suppression from bare charge detonation has typically taken the form of heavy steel mesh matting or heavy baffling plates and walls to provide mechanical constraint of the bare charge blast. Aqueous foam suppression has also been used in this application. As in the applications previously discussed, foam suppression requires a containment vessel and a foam generator.

OBJECTS AND SUMMARY OF THE INVENTION

Accordingly, it is an object of the invention to provide a blast reduction method and apparatus which overcome the drawbacks of the prior art.

More specifically, it is a object of the present invention to provide a blast reduction method and apparatus which employs a gas having properties different from air confined adjacent the source of the blast to reduce blast and noise over-pressure.

It is a further object of the invention to provide means for producing an acoustic impedance mismatch between a blast and the ambient air which alters the blast strength as it propagates first into a suppressant gas and secondly into the atmosphere.

It is a further object of the invention to provide a blast reduction device which is lightweight and portable, does not require special generation devices, is geometrically adaptable to a variety of blast reduction applications and does not interfere with normal functioning of the weapon system to which it is applied.

According to an aspect of the invention, there is provided an apparatus for reducing blast from an explosive source comprising means for supplying a gas having properties different from ambient air, and means for containing said gas in the vicinity of the source whereby the blast is forced to propagate through the gas before reaching the ambient air.

According to a feature of the invention, there is provided a method of reducing blast from an explosive source comprising the steps of deploying a container of gas having properties different from air in the vicinity of the explosive source and propgating the blast through the container of gas before propagating it through ambient air.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 1 shows a perspective view of the muzzle of a gun on which a gaseous blast reducer according to the present invention is mounted in its undeployed condition;

FIG. 2 is a perspective view corresponding to FIG. 1 in which the gaseous blast reducer is in its deployed condition;

FIGS. 3–7 are schematic representations of a theoretical one-dimensional shock tube to which reference will be made in explaining the principle of blast reduction employing an intervening gas;

FIG. 10 is a perspective view of a rocket launcher having installed thereon a gaseous blast reducer according to the present invention in its undeployed condition;

FIG. 11 is a perspective view of the rocket launcher of FIG. 10 but in its deployed condition with the gaseous blast reducer according to the present invention fully inflated;

FIG. 12 is a perspective schematic view of a gaseous blast reducer adapted for reducing the blast from a bare charge explosion.

DETAILED DESCRIPTION OF THE PREFERRED EMBODIMENT

Figure 6:
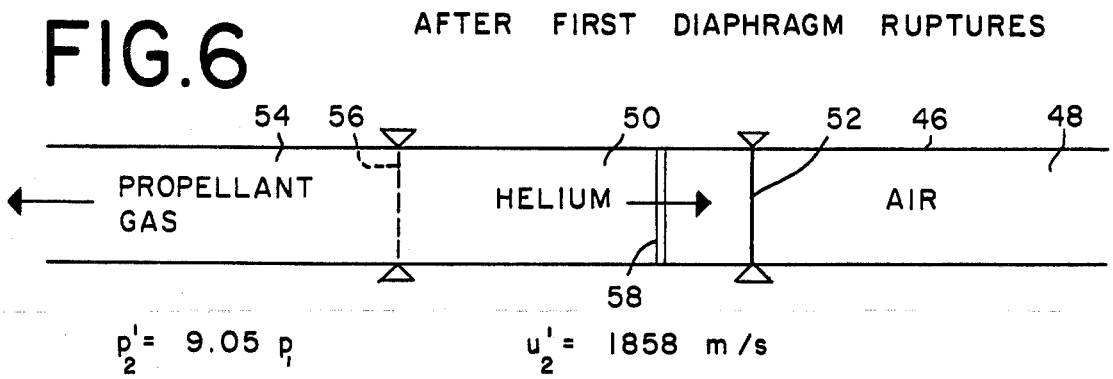

Referring to FIG. 1, there is shown, generally at 10, a gaseous blast reducer in an undeployed condition on a tube type weapon such as a gun 12. Gun 12 includes a muzzle 14 over which an inflatable structure 16 is disposed.

Inflatable structure 16 is preferbly a thin film of suitable material such as, for example, of rubber or plastic material having a cuff 18 which may be attached over muzzle 14 and a substantial expansion supply of material 20 which is preferably compactly stowed as shown on muzzle 14.

The above requirements of the inflatable structure 16 may be satisfied, for example, by a balloon of a thin film of synthetic rubber which is suitably inflatable as will be described. However, permanent installation of inflatable structure 16 on muzzle 14 is not required. In addition, the installation of inflatable structure 16 employing a cuff 18 is disclosed for convenience of description of a preferred embodiment. In fact, inflatable structure 16 may be simply pressed against muzzle 14 in any suitable fashion either in the uninflated or inflated conditions such that the blast and projectile enter inflatable structure 16 through one side thereof, pass through the space containing the gaseous material and exit through the material at another side.

A gas supply such as, for example, a gas bottle 22 containing a pressurized supply of gas giving the required properties of density, speed of sound, etc. is affixed to gun 12 by any convenient means such as by bands 24 and 26.

A nozzle, or tube 28 from gas bottle 22 is attached to a filler neck 30 of inflatable structure 16. A control device such as, for example, a valve 32 controls the flow of gas from gas bottle 22 into inflatable structure 16.

Valve 32 may be actuated in any convenient manner such as, for example, manually by the weapon operator or automatically immediately prior to firing gun 12. For concreteness of description, valve 32 is shown as a manual valve. This should not be taken as a limitation but merely as an illustrative convenience.

Referring now to FIG. 2, inflatable structure 16 is shown in its deployed condition on muzzle 14. Gas from gas bottle 22, which has filled inflatable structure 16, provides a large gas-filled body 34 in front of muzzle 14.

In order to analyze the blast reduction phenomenon attributable to the invention shown in FIGS. 1 and 2, reference is made to FIGS. 3–7. The results in the following analysis are derived using one-dimensional gas dynamic theory according to the textbook, *Elements of Gas Dynamics,* by H. W. Liepmann and A. Roshko, John Wiley and Sons, 1962, herein incorporated by reference.

In FIG. 3, a one-dimensional shock tube 36 is shown having a first region 38 containing air at atmospheric pressure $p_1$ and density and at zero velocity $u_1$, divided from a second region 40 containing propellent gas at an elevated pressure $p_4$ such as, for example, 270 times atmospheric pressure, and zero velocity $u_4$ by a diaphragm 42. Air is assumed to have a ratio of specific heats $\gamma_1=1.4$ compared to $\gamma_4=1.25$ for the propellent gas.

In FIG. 4, it is assumed that diaphragm 42 has ruptured and a blast wave 44 is propagated along shock tube 36. Under these conditions, the pressure $p_2$ behind blast wave 44 is 25.7 atmospheres and the gas velocity $u_2$ is 1349 meters per second.

The above-described experiment may be repeated using a shock tube 46, such as shown in FIG. 5, having a first region 48 containing air at atmospheric pressure $p_1$ and density and zero velocity $u_1$ separated by a first diaphragm 52 from a second region 50 containing helium at atmospheric pressure $p'_1$ and zero velocity and a third region 54 containing propellent gas at a pressure $p_4$ of 270 atmospheres and zero velocity $u_4$ separated from second region 50 by a second diaphragm 56. The helium gas is assumed to have a ratio of specific heats $\gamma'_1=1.67$.

Referring now to FIG. 6, which illustrates the condition just after rupture of second diaphragm 56, a blast wave 58 propagates through the helium gas in second region 50 toward first diaphragm 52. The intermediate conditions in second region 50 indicate a pressure $p'_2$ of 9.05 times atmospheric and a velocity $u'_2$ of 1858 meters per second.

As would be clear to one skilled in the art, a reflected wave also propagates backward through third region 54 from second diaphragm 56.

Figure 7:
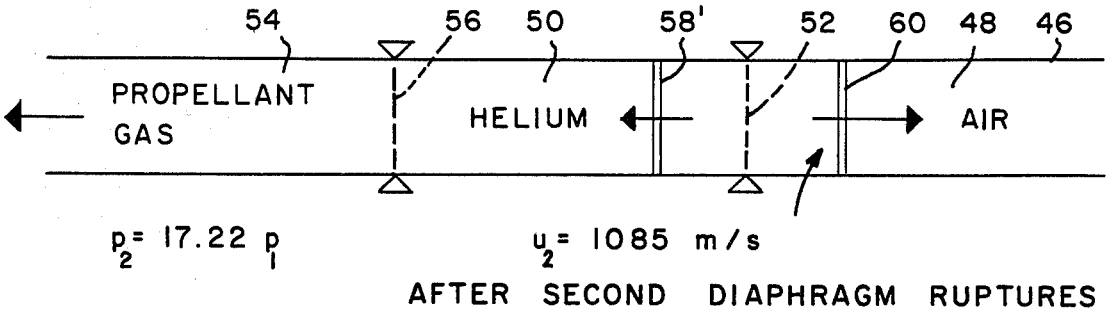

Referring now to FIG. 7, the condition is shown just after first diaphragm 52 is ruptured. A blast wave 60 propagates through the air in first region 48 while a reflected blast wave 58' propagates backward through second region 50. The conditions behind blast wave 60 indicate a pressure $p_2$ of 17.22 times atmospheric and a velocity $u_2$ of 1085 meters per second. That is, a reduction in pressure from 25.7 to 17.22 atmospheres compared to the embodiments shown in FIGS. 3 and 4 and a reduction in velocity from 1349 to 1085 meters per second from the embodiments shown in FIGS. 3 and 4.

Although a fully one-dimensional flow would eventually cause the two cases to produce identical flows far from the region of diaphragm rupture, in the case of muzzle blast, spherical expansion prevents or inhibits such wave interaction due to the effective spherically symmetric geometry of gas-filled body 34 (FIG. 2) and a scaled dimension is added to the flow where the scaled dimension is related to the radius of gas-filled body 34.

EXAMPLE 1

Figure 8:
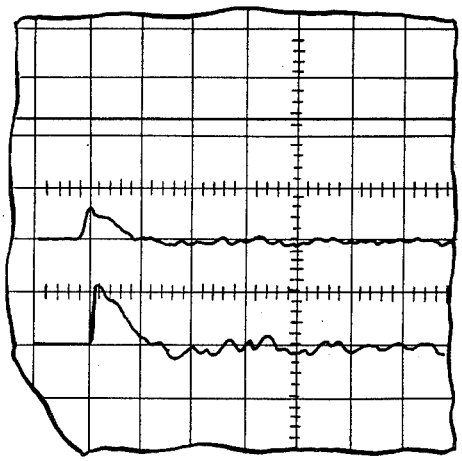
FIG. 8 is a graph of an oscilloscope trace illustrating a recording of a blast wave with a bare muzzle.

A comparative test was made of muzzle blast using a 5.56 mm rifle both with and without a gaseous blast reducer according to the embodiment of FIGS. 1 and 2. An acoustic transducer was placed 15 calibers from the weapon muzzle. When the weapon was fired with a bare muzzle, the peak over-pressure level at the transducer station was 0.544 atmospheres (8.0 psi). An oscilloscope trace of the transducer output, as shown in FIG. 8, indicated a sharp rise followed by a relatively slow decline in acoustic output.

Figure 9:
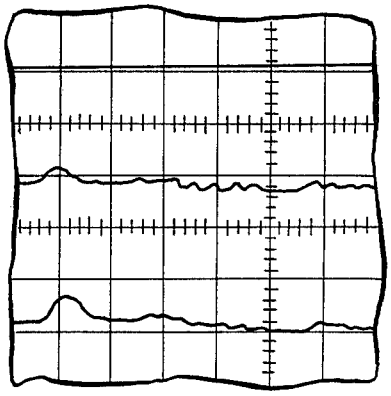
FIG. 9 is a graph of an oscilloscope trace similar to FIG. 8 wherein a gaseous blast reducer is used according to the present invention.

A helium filled balloon having a diameter equal to 10 calibers was fitted over the muzzle. The peak over-pressure was 0.238 atmospheres (3.5 psi) and an oscilloscope recording exhibited the shape shown in FIG. 9. A reduction in peak over-pressure to less than half of the unsuppressed value is significant. In addition, comparison of FIGS. 8 and 9 indicates the substantially shallower slope of the rise of the suppressed acoustic signal. Such a shallower rise can be expected to contain a reduced number of harmonics and generally lower frequencies. From the standpoint of noise pollution, the changed character of the sound may have as much, or more, pyschological significance as the gross reduction in acoustic amplitude.

Referring now to FIG. 10, a shoulder-fired closed rocket launcher 62 is shown employing a gaseous blast reducer 10 according to the present invention. Rocket launcher 62 includes an outer tube 64 and an inner tube 66 telescoped into outer tube 64. A firing trigger 68 and a peep sight 70 of a conventional type are included on the side of outer tube 64.

As is conventional, rocket launcher 62 may be a one-time-use throw-away device supplied containing a rocket (not shown) within outer tube 64.

Referring now to FIG. 11, rocket launcher 62 is shown in the firing position with inner tube 66 extended forward in order to reduce the effect of muzzle blast on the operator. Inflatable structure 16 is inflated before firing as in the embodiment previously described to place a gas-filled body 34 in front of muzzle 72. The acoustic blast resulting from firing rocket launcher 62 is attenuated and modified in a manner similar to that for the gun example due to the acoustic mismatch provided by the additional gas-to-gas interface through which any blast wave must propagate.

Referring now to FIG. 12, there is shown, generally at 74, a gaseous blast reducer according to a third embodiment of the invention and especially adapted for blast reduction in a bare-charge explosion. A bare charge 76 is disposed as shown with respect to a horizontal surface. A membrane 78 generally centered on bare charge 76 assumes a roughly hemispherical shape to enclose a gas-filled region 80. The perimeter 82 of membrane 78 may be secured to the surface by any suitable means such as by weighting or by stakes 84 engaging tabs 86 attached to perimeter 82. A gas suupply vessel such as, for example, pressurized gas bottle 88, including a control valve 90, is operative to feed a suitable gas such as, for example helium, through a filler neck 92 into the interior of membrane 78.

Membrane 78 may include a plane bottom member (not shown). However, if a gas such as helium which is lighter than air is used, a bottom may not be necessary. That is, as the gas is added under membrane 78, the lift provided by the gas may be sufficient to raise membrane 78 into the dome shape illustrated. Furthermore, in this event, it may not be necessary to have an accurately shaped membrane 78. In fact, a plane sheet of film such as, for example, a film of polyethylene plastic, may be loosely spread and secured over bare charge 76 and, when the gas is added thereunder to lift the film, a generally hemispheric shape such as shown in FIG. 12 may be assumed by the film.

Having described specific embodiments of the invention with respect to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. Apparatus for reducing blast from an explosive source which includes:

a gun barrel having a muzzle;

means for supplying a gas, which includes a pressurized container containing said gas;

means for containing said gas in the vicinity of said source whereby the blast is forced to propagate through said gas before reaching ambient air which includes:

an inflatable membrane; and means for securing said inflatable membrane over said muzzle; and means for releasing said gas into said means for containing.

2. Apparatus according to claim 1 wherein said inflatable membrane is inflatable by said gas to a generally spherical shape.

3. Apparatus as recited in claim 1 wherein said gas is helium.

4. Apparatus for reducing blast from an explosive source which includes:

a rocket launcher having an outlet;

means for supplying a gas which includes a pressurized container containing said gas;

means for containing said gas in the vicinity of said source whereby the blast is forced to propogate through said gas before reaching ambient air which includes:

an inflatable membrane; and means for securing said inflatable membrane over said outlet; and means for releasing said gas into said means for containing said gas.

5. Apparatus according to claim 4 wherein said rocket launcher includes means for deploying a portion thereof, and said means for supplying a gas includes automatic means for supplying said gas in response to actuation of said means for deploying.

* * * * *